United States Patent [19]

McElwain et al.

[11] 4,301,641

[45] Nov. 24, 1981

[54] ARTICLE TRANSFER APPARATUS

[75] Inventors: Merle G. McElwain, Felton; Gary D. Keckler, New Oxford, both of Pa.

[73] Assignee: Caterpillar Tractor Co., Peoria, Ill.

[21] Appl. No.: 183,510

[22] Filed: Sep. 2, 1980

[51] Int. Cl.[3] ..... B65B 57/14; B65B 5/10

[52] U.S. Cl. ..... 53/493; 53/503; 53/504; 53/244; 414/295; 73/304 R

[58] Field of Search ..... 53/493, 244, 52, 503, 53/248, 260, 504; 414/295, 161; 73/149, 304 R

[56] References Cited

U.S. PATENT DOCUMENTS

| | | | |
|---|---|---|---|
| 3,100,347 | 8/1963 | Fritze | 73/304 R X |
| 3,254,755 | 6/1966 | O'Brien | 414/295 |
| 3,273,304 | 9/1966 | Winter et al. | 53/496 |
| 3,952,888 | 4/1976 | Currie | 414/400 |
| 4,183,427 | 1/1980 | Tomikawa | 414/752 X |
| 4,194,343 | 3/1980 | Myers et al. | 53/493 |

FOREIGN PATENT DOCUMENTS

| | | | |
|---|---|---|---|
| 1062663 | 4/1954 | France | 414/295 |

*Primary Examiner*—Horace M. Culver
*Attorney, Agent, or Firm*—Robert A. McFall

[57] ABSTRACT

An article transfer apparatus (10) is provided for transferring articles (16) from a predetermined first position to a varying second position and discharging the articles (16) at the second position. Difficulty is often encountered in controlling the drop height of articles (16) delivered by a conveyor (18) for random placement at varying levels in a container (12). It is desirable to minimize the drop height to prevent damage to the article (16). A carriage (36) on the article transfer apparatus (10) is controllably operated to controllably discharge articles (16) at a preselected distance above either the bottom of the container (12) or articles (16) predisposed within the container (12). The invention is particularly useful for transferring finished metal piston pins (16) from a conveyor (18) to a tote box (12).

8 Claims, 5 Drawing Figures

10
12
14
16
18
20
22
26
28
30
32
34
36
38
40
44
46
47
48
50
52
56
60
64
66
68
72
76
80
86
88
90
92
96
98
100
104
106
108
110
112
114
116
118
120
124
130
134
136
138
140
142
146
148
150
152
154
156
158
160
162
164
166
168
170
172
200
202
204
206
208
210
212

88
AIR
96
136
144
124
132
145
102
90
94

138
108
110
126
120
103
134
140
106
100
72
128
116
74
122
98
66
142
112
114
78
118
70
68
76
80

172
174
198
176
200
152
188
212
180
170
184
182
208
190
200
186
192
152
196
156
202
145
178
204
103
194

ARTICLE TRANSFER APPARATUS

DESCRIPTION

Technical Field

This invention relates generally to an apparatus for transferring articles from a conveyor to a container, and more particularly to an apparatus for sequentially transferring articles from a predetermined first position to a varying second position and discharging the articles at the varying second position.

Background Art

Article transfer apparatus of various constructions are conventionally used to transfer articles from one position to another position. The transfer may be between two varying or changing positions such as between two moving conveyors, between two predetermined or fixed positions such as between two stationary work stations, or between a fixed and a varying position. It is to this latter arrangement that the present invention is directed.

One example of an article transfer apparatus for moving an article between fixed and varying positions is described in U.S. Pat. No. 3,952,888 issued to Richard W. Currie on Apr. 27, 1976. The Currie patent describes a cart loading apparatus for transferring palletized cartons from a fixed elevation pallet receiving station to an elevationally varying pallet discharging station. The discharge position is determined by lowering a vertically moving support plate or carriage and allowing the carriage to rest upon the bed of a cart or vehicle after which the lowering mechanism for the carriage continues to move until a mechanically activated limit switch is closed. After the carriage is at rest on the vehicle bed, a multiplicity of mechanical arms and switches control the horizontal movement of the pallets from the transfer apparatus onto the vehicle.

Another example of an article transfer apparatus for moving articles between fixed and varying positions is described in U.S. Pat. No. 4,183,427 issued to Hisao Tomikawa on Jan. 15, 1980. The Tomikawa patent describes an apparatus for sensing a varying article receiving position controlling a movable carriage to receive the article at the varying position, transferring the article to a fixed second position, and then discharging the article at the second position. As in the Currie patent, the apparatus described by Tomikawa employs a mechanically activated switch to determine the location of the varying position.

It is also known to use various non-mechanical devices such as proximity sensors and Hall-effect switches to control article transfer apparatus. However, these as well as mechanically actuated devices such as those outlined above, have been found ineffective for controlling the movement of a carriage for controllably discharging articles at a preselected distance above the bottom of a container or above previously placed articles disposed within the container. For example, semi-finished or finished metal articles such as piston pins, track pins and track bushings have heretofore been easily damaged when allowed to drop unimpeded, from a conveyor into a tote box. When an empty tote is first placed adjacent to a conveyor discharge station, the first few articles being transferred may drop a distance of 2 or 3 feet (0.7 to 1 m) from the conveyor to the container. As a result of the drop, the article may become nicked or otherwise deformed. If the nicks or deformities are not removable in subsequent grinding or machining operations, the articles must be scraped.

Another problem is presented when large, heavy parts such as links for a crawler vehicle track chain are dropped from a conveyor into a container. In this operation, damage to the links is not as much of a problem as is the noise generated by articles banging against each other in the container at the end of the drop.

In both of the above situations the problem of sequentially receiving and controllably discharging articles in a container is compounded by the requirement to determine the elevational level of articles previously deposited. As the quantity of articles in the container varies, the optimal elevational position at which the articles should be discharged also varies. The problem of determining or sensing the optimal elevation position is made worse by the random orientation of previously placed articles. Typically, even symetrically shaped articles do not always fall and come to rest in the same position, and consequently, articles do not always stack or pile in the same fashion. For this reason, mechanical fingers or probes such as those described in the above mentioned prior art have generally proven unsatisfactory. Likewise, various proximity sensors have also been rejected because of problems associated with distinguishing between metallic articles and the metallic container in which the articles are placed. Also, if the proximity sensors are focused too narrowly they may not sense the presence of a article extending elevationally above the sampled area and consequently the lowering apparatus may itself strike the extending article and thereby cause damage to the article or the transfer apparatus or both.

The present invention is directed to overcoming one or more of the problems as set forth above.

DISCLOSURE OF THE INVENTION

In accordance with one aspect of the present invention an article transfer apparatus includes a vertically movable carriage mounted within a frame for movement between a predetermined first position and a varying second position located a preselected distance above either the bottom of a container or parts within the container. A plurality of sensing members depend from the carriage for sensing the location of the varying second position and delivering a signal in the form of an electrical signal passing from the sensing members through the container and to a control unit. The control unit, upon receiving the signal, controls the discharge of an article from the carrier.

The transfer of an article from a fixed to a varying position presents many problems. The problem is made more difficult when the location of the varying position is not easily determined such as when articles which, when stacked within a container, assume a random orientation. It is necessary to accurately and repeatably determine the varying location of such articles in order to controllably place additional articles on top of those already accumulated in the container.

The present invention effectively provides a solution to the above-outlined problem by providing a plurality of spaced-apart flexible sensing members depending from an article-containing carrier. Upon contact with electrically conductive articles in a conductive container or, if absent of articles, simply with the container. The sensing members deliver an electrical signal through the articles and container, or solely through the container, to a control unit. The control unit, upon receiving the signal thus provided, operates to accurately and controllably discharge the article from the carriage at a preselected distance above the stack of previously placed articles in the container. In the case where the container is empty, the control accurately and controllably operates to discharge the article at a preselected distance above the container bottom panel.

By discharging articles from a carrier at a preselected distance above other articles, the drop distance or free fall distance of the article thus discharged is controlled. As a result of controlling the drop distance, damage to the article and excess noise generation is avoided.

BEST MODE FOR CARRYING OUT THE INVENTION

Figure 1:
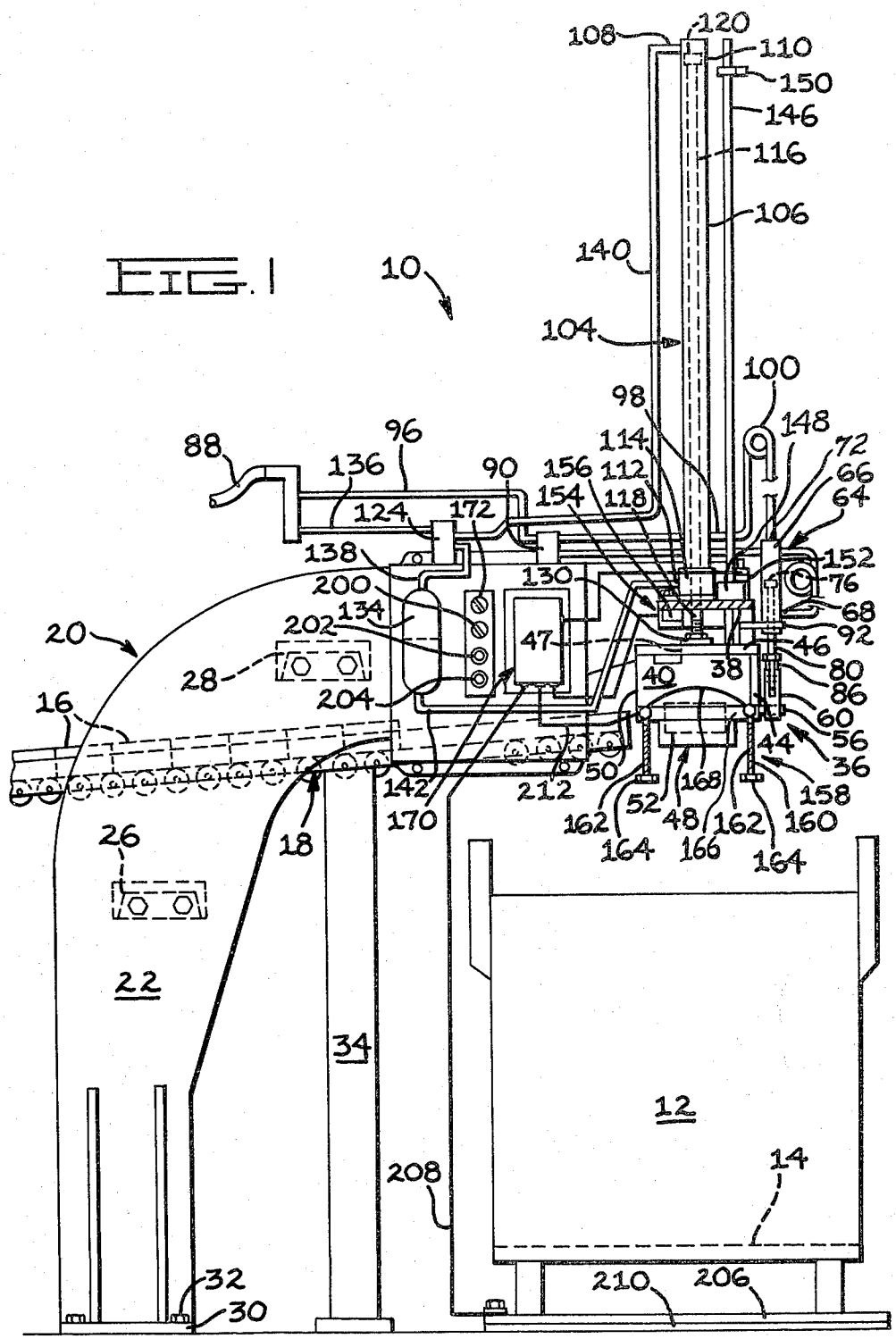
FIG. 1 is a side elevational view of an embodiment of the present invention with a portion of the frame broken away to show details of the carriage.
Figure 2:
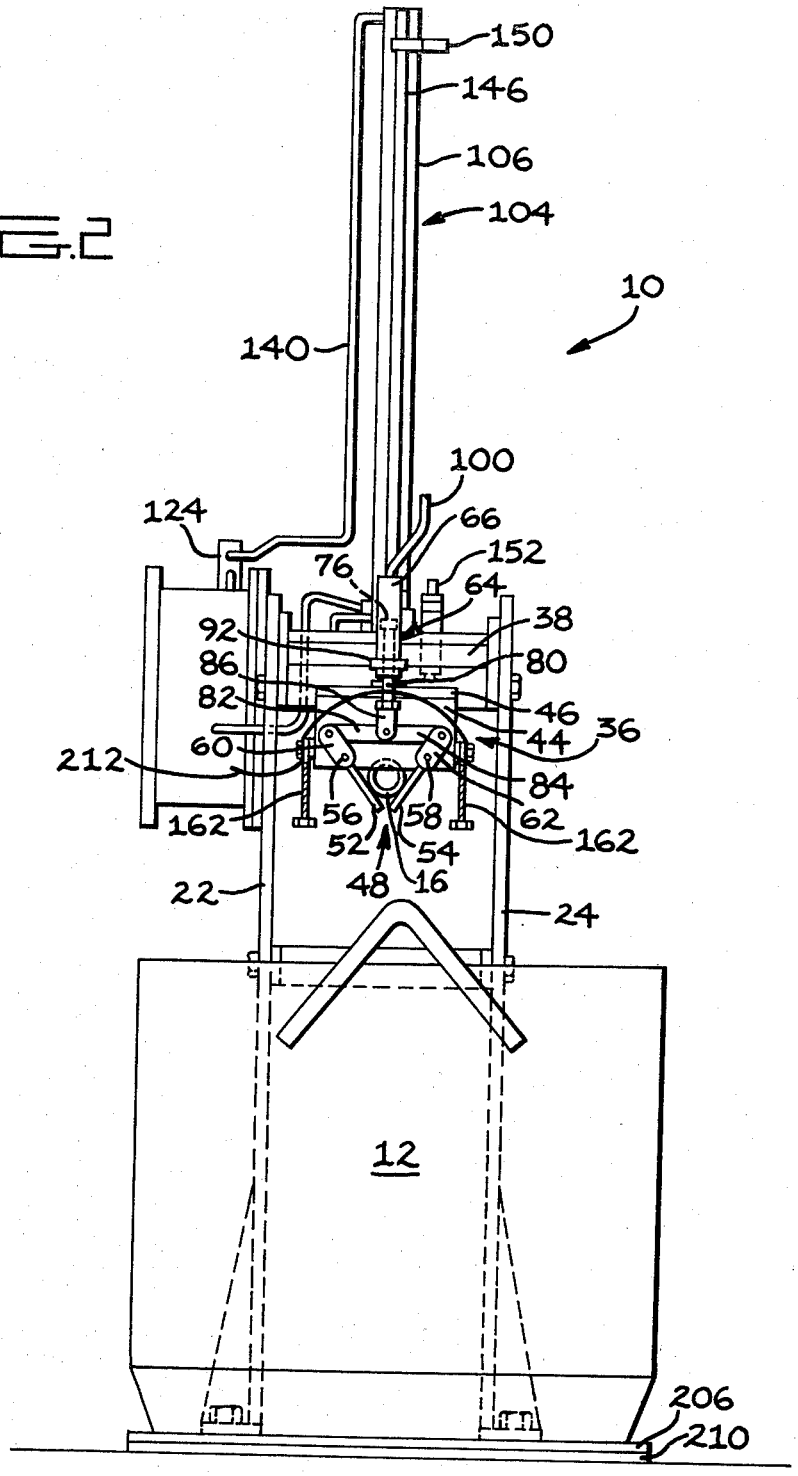
FIG. 2 is an end view of the embodiment of the present invention shown in FIG. 1 with the carriage at a predetermined position for receiving an article.
Figure 3:
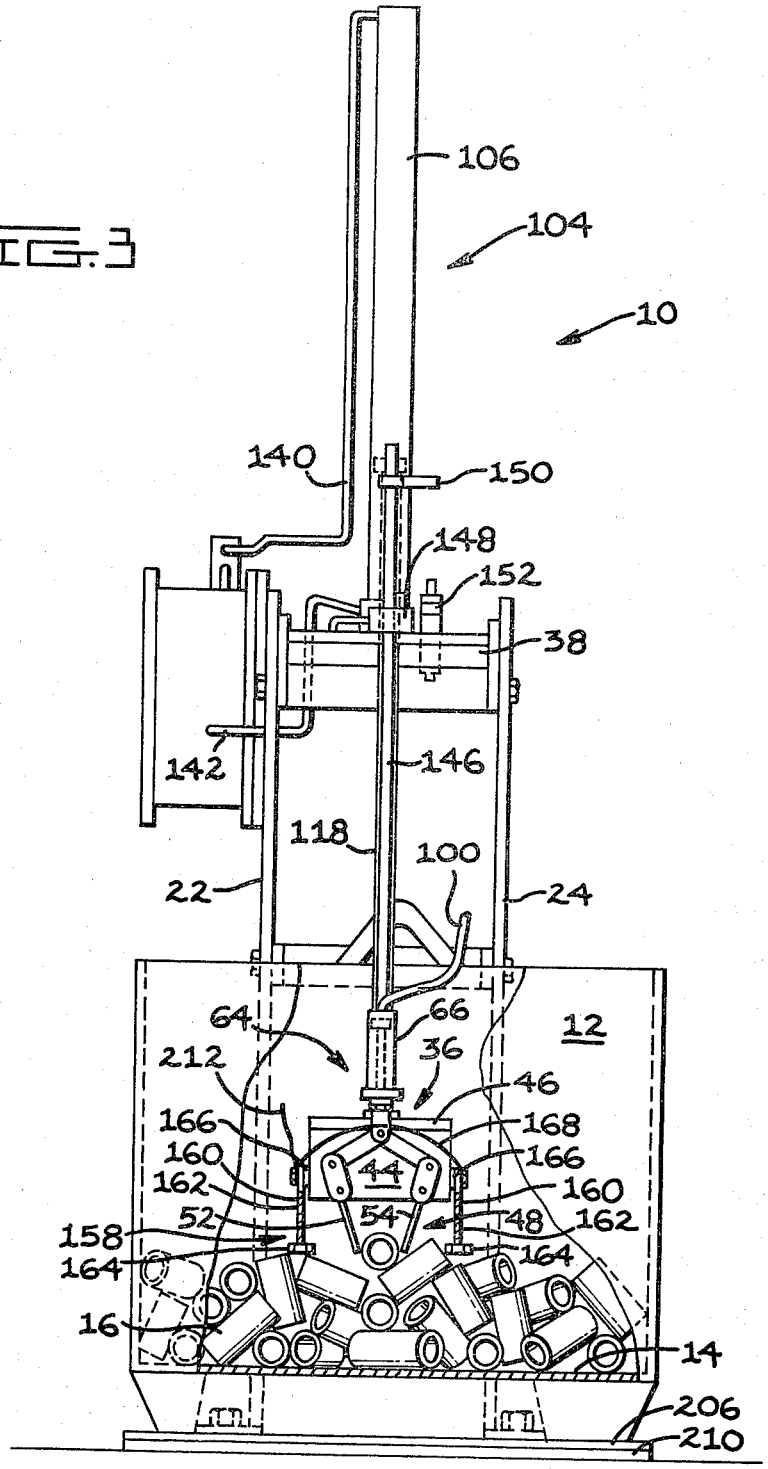
FIG. 3 is an end view of the embodiment of the present invention shown in FIG. 1 with the carriage at a varying position a predetermined distance above a stack of articles in a container.

In the preferred embodiment of the present invention shown in FIGS. 1, 2 and 3, an article transfer apparatus 10 is shown in conjunction with a metal container 12 having a metal bottom plate 14 for receiving and storing a quantity of metal articles 16 therein. The metal articles 16 shown in the preferred embodiment are piston pins having an elongated cylindrical shape with a hollow bore concentrically disposed along a central axis of the cylinder, and are sequentially delivered to the article transfer device by a V-chute type conveyor 18 located about 26 inches (0.7 m) elevationally above the bottom plate 14 of the container 12.

The article transfer apparatus 10 includes a frame 20 having a pair of vertically oriented plates 22,24 spaced apart and maintained in fixed parallel relationship by a pair of channel members 26,28. A lower end of the frame 20 includes a mounting plate 30 secured to the floor by a plurality of anchor bolts 32. A pedestal 34 having a lower end attached to the floor and an upper end attached to the conveyor 18 supports the conveyor in an aligned and fixed relationship centrally between the plates 22,24.

A carriage 36 is movably mounted within the frame 20 by a bracket 38 connected to the plates 22,24. The carriage 36 includes a pair of parallel sidewalls 40,42 spaced apart by an end wall 44, a top plate 46 having a slotted opening 47 formed therein, and a bottom member 48, thereby forming a semi-enclosed chamber having an open end 50 adjacent the conveyor 18 when the carriage is located at a predetermined first position as shown in FIGS. 1 and 2. The bottom member includes a pair of gates 52,54 each being respectively pivotably mounted to the sidewalls 40,42, by a pair of bearing blocks, not shown, for movement between a closed and an open position.

Each of the gates 52,54 respectively have a stub shaft 56,58 formed along an upper end of the gates, the shafts being of a length sufficient to extend through the end wall 44 and engage a bore provided on a first end of a pair of fixed links 60,62. The gates 52,54 and respective links 60,62 are secured together in fixed relationship by a transverse roll pin or keyway arrangement between the link bores and gate shaft.

A means 64 is provided for moving the gates 52,54 of the bottom member 48 between open and closed positions. The means 64 includes an air cylinder 66, a port 68 for pressurized air at a first end 70 of the cylinder and a port 72 for pressurized air at a spaced second end 74, a piston 76 having a head 78 movably disposed in the cylinder and a rod end 80 connected to the head, the fixed links 60,62, a pair of movable links 82,84, and a clevis 86 connecting the rod end 80 of the piston to the bottom member 48 of the carriage 36. The means 64 also includes a source of pressurized air 88 as shown schematically in FIG. 4, and a first valve means 90 for controlling the flow of pressurized air to the cylinder 66.

As best seen in FIG. 2, the fixed links 60,62 are pivotally connected at a second end of the fixed links, respectively, to the movable links 82,84. The movable links, at an end opposite the connection to the fixed links, are each pivotably connected to the clevis 86. The clevis is attached to the rod end 80 of the piston 76 for compliant travel with the piston in response to directing a supply of pressurized air through the first valve means 90 to one or the other of the inlet ports 68,72 of the air cylinder 66. The cylinder 66 is mounted to the top plate 46 of the carriage 36 by a bracket 92 thereby securing the cylinder in fixed relationship with the carriage.

Figure 4:
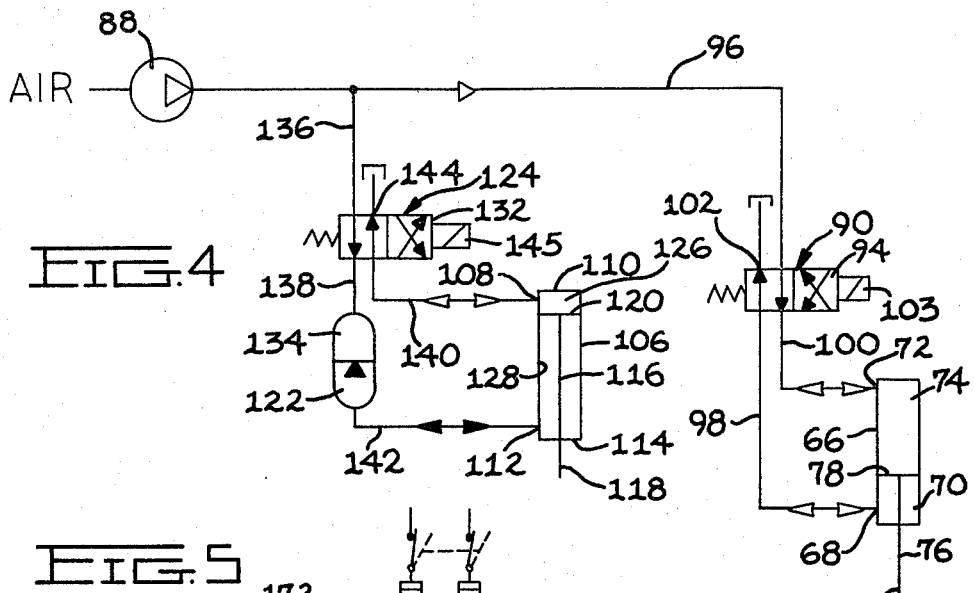
FIG. 4 is a schematic diagram of the pneumatic and hydraulic circuits of the embodiment of the present invention shown in FIG. 1.

As best seen in FIG. 4, the first valve means 90 for controlling the flow of pressurized air to the cylinder includes a solenoid operated, two position, 4-way valve 94, a plurality of conduits 96, 98, 100 and a vented first port 102 provided on the valve 94. The conduit 96 connects the source of pressurized air 88, to a second port of the valve 94, the conduit 98 provides communication between a third port of the valve and the inlet port 68 of the cylinder 66, and the conduit 100 provides communication between a fourth port of the valve and the inlet port 72 of the cylinder.

The valve 94 is arranged so that when it is in a spring biased normal or first position represented by the left-hand block in FIG. 4 pressurized air is directed from conduit 96, through the valve 94 and conduit 100 to port 72 of the cylinder 66. Port 68 of the cylinder is vented to the atmosphere by way of the conduit 98, valve 94 and the vented port 102, and piston 76 is accordingly urged towards the first end 70 of the cylinder. When a solenoid coil 103 is energized in response to receiving an electrical signal, the valve 94 is positioned at a second position and air flow through the valve is directed as represented by the right-hand block in FIG. 4. In the second position, pressurized air is directed from conduit 96, through the valve 94 and the conduit 98 to the port 68 of the cylinder 66, the port 72 is open to atmosphere through conduit 100, the valve 94 and the vented port 102, and the piston 76 is urged towards the second end 74 of the cylinder.

A means 104 is provided for vertically moving the carriage 36 between a predetermined first position as shown in FIGS. 1 and 2 and a varying second position as shown in FIG. 3. The means 104 includes an air over oil cylinder 106 having an inlet 108 for pressurized air at a first end 110, an inlet 112 for pressurized oil at a second end 114, and a piston 116 having a rod portion 118 connected to the carriage 36 and a head portion 120 movably disposed within the cylinder 106, the source of pressurized air 88, a source of pressurized oil 122, and a second valve means 124 for controlling the flow of pressurized air and oil to the cylinder.

The cylinder 106 is mounted on the non-movable frame bracket 38. The head portion 120 of the piston 116 divides the cylinder into a separate air chamber 126 in communication with the inlet 108 and a separate oil chamber 128 in communication with the inlet 112. The rod portion 118 is connected to the carriage 36 by screwthreadably engaging a threaded boss 130 formed on the top plate 46.

The second valve means 124 for controlling the respective flows of pressurized air and oil to the cylinder 106 includes a solenoid operated, two position, 4-way valve 132, an air over oil accumulator 134, a plurality of conduits 136, 138, 140, 142, and a vented first port 144 provided on the valve 132. The conduit 136 connects the source of pressurized air 88 to a second port of the valve, the conduit 138 provides for the communication of air between a third port of the valve and the accumulator 134, and conduit 140 provides for the communication of air between a fourth port of the valve and the inlet 108 of the cylinder 106. The conduit 142 is an oil line connecting the source of pressurized oil 122 within the accumulator 134 with the inlet 112 of the cylinder.

The valve 132 is arranged so that when it is in a spring biased first position represented by the left-hand block in FIG. 4, pressurized air is directed from conduit 136, through the valve 132 to the accumulator 134. Pressurized air in the accumulator serves to pressurize an oil reservoir and produces a source of pressurized oil 122 which is directed through the conduit 142 and the inlet 112 into the oil chamber 128 of the cylinder 106. Port 108 of the cylinder is vented to atmosphere by way of the conduit 140, the valve 132 and the vented port 144. With the valve 132 in the first position, the piston 116 is urged towards the first end 110 of the cylinder and the carriage is in the raised or predetermined first position. When a solenoid coil 145 of the valve 132 is energized, the valve is moved to a second position as represented by the right-hand block in FIG. 4. In the second position, pressurized air is directed from conduit 136, through the valve 132 and the conduit 140 to the port 108 of the cylinder. Simultaneously, the accumulator 134 is vented to atmosphere through the conduit 138, the valve 132 and the vented port 144, thereby reducing the pressure on the oil supply 122 and allowing oil to flow from the oil chamber 128 in the cylinder through the conduit 142 and into the accumulator 134. Air pressure in the air chamber 126 of the cylinder is therefore greater than oil pressure in the oil chamber 128 and the piston 116 with the carriage 36 attached thereto is urged downwardly towards a second varying position as shown in FIG. 3. Return of the valve to the first position halts the downward movement and returns the piston to the aforementioned first predetermined position.

A vertically oriented guide rod 146 is attached to the top plate 46 of the carriage 36 and slidably extends through a sleeve bearing 148 secured to the frame bracket 38. The guide rod maintains the carriage in alignment with the frame and conveyor during vertical movement of the carriage. An angle bracket 150 is mounted on an upper end of the guide rod 146 and cooperates with a limit switch 152 mounted on the frame bracket 38 to restrict downward movement of the carriage beyond a preselected distance.

A sensor means 154 for detecting the presence of an article 16 in the carriage 36 when the carriage is in the position shown in FIGS. 1 and 2 includes a photoelectric scanner 156. The scanner is mounted on the frame bracket 38 vertically above the slotted opening 47 in the top plate 46 and adjacent the open end 50 of the carriage 36, and is oriented to sense the presence of an article 16 in the carriage and more particularly to detect the entrance of an article into the carriage upon discharge from the conveyor 18.

As best shown in FIG. 3 a first means 158 for sensing the location of a varying second position located a preselected distance above either the bottom of the container 12 or articles 16 within the container includes a plurality of spaced apart flexible members 160 depending from the carriage 36. The members 160 include four woven metal wire cables 162 each having a metal nut 164 brazed to the cable at a lower end thereof. The cables 162 are attached at an upper end to the carriage 36 near the corners thereof and depend a preselected distance below the bottom member 48. The cable and nut assemblies are electrically conductive, are spaced from the carriage by an insulator 166 and electrically interconnected by a plurality of wire conductors 168. Thus when any part of one of the flexible members contact either the bottom plate 14 of the container 12 or an article 16 present in the container, an electrical circuit is established between the flexible members 160 and the plate 14, and a signal may be delivered in response to such contact.

A second means 170 receives a signal provided by the first means 158 and discharges the article 16 from the carriage 36 in response to receiving the signal. As shown schematically in FIG. 5, the second means includes primary control switch 172, a first control relay 174 having a pair of normally open contacts 176,178, a resistance sensitive relay 180 having a normally closed contact 182 and a normally open contact 184, a second control relay 186 having a normally closed contact 188, a normally closed time delay to open contact 190, and a pair of normally open contacts 192,194, and a third control relay 196, operated by the photoelectric scanner 156, and having a normally open time delay to close contact 198. In addition to the above control relays, the circuit includes a plurality of manually operated switches 200, 202 and 204.

As shown in FIGS. 1, 2 and 3, the article transfer apparatus includes an electrically conductive support member 206 such as a flat metal plate disposed in supporting relationship with the container 12 and electrically connected to the second means 170 by a wire 208. The support member is preferably electrically isolated from the floor by a non-conductive member 210 disposed between the plate and the floor. The member 210 may be formed of any suitable non-conductive material, such as nylon, and serves to prevent electrical contact by way of the floor between the frame 20 and the electrically conductive support member 206. A wire 212 is connected between one of the flexible members 160 and the second means 170.

Industrial Applicability

Figure 5:
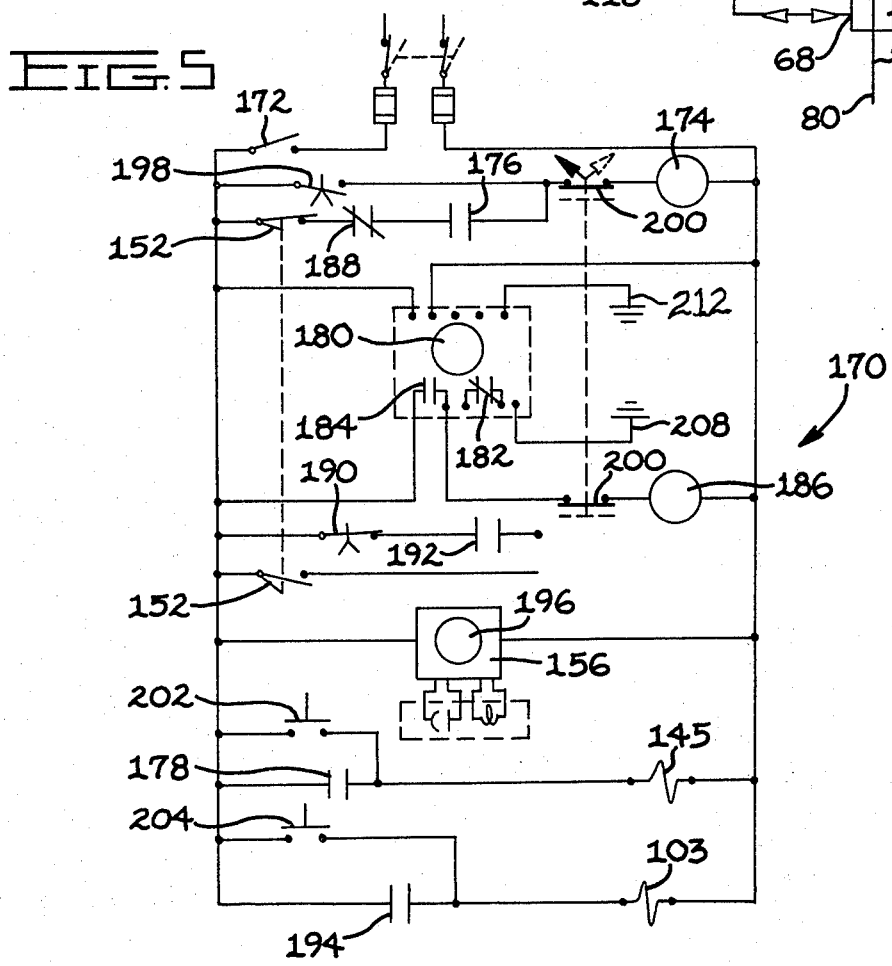
FIG. 5 is a schematic diagram of the electrical circuit of the embodiment of the present invention shown in FIG. 1.

The article transfer apparatus 10 is placed in operation by closing the manually operated switch 172, and placing the mode selection switch 200 in the automatic operation position, thereby arranging the components of the second means 170 in the manner represented by the schematic circuit diagram shown in FIG. 5, and directing conventional 115 Vac line voltage to the photoelectric scanner 156. Since no voltage is present at either of the solenoid coils 103 or 145 due to the position of the normally open contacts 194 and 178 respectively, the valves 94 and 132 are positioned as shown in FIG. 4. The respective valve positions place the gates 52,54 in a closed position for retaining articles 16 within the carriage 36 and the carriage is in a raised or a predetermined first position as shown in FIGS. 1 and 2.

The metal articles 16 are delivered sequentially by the conveyor 18 to the article transfer apparatus 10. As an article passes under the photoelectric scanner 156, the presence of the article is detected by the scanner and the third control relay 196, actuated in response to a signal from the scanner, operates to initiate closing of the time delay to close contact 198. A short time delay in the order of 1 to 2 seconds is desirable to assure that the article 16 is fully received within the carriage 36 before full closure of the contact 198.

Upon closure of the contact 198, voltage is present at the first control relay 174 and the normally open contact 176 closes to seal the relay. Also, normally open contact 178 closes to provide voltage to the solenoid coil 145, shifting the valve 132 to the second position. The carriage 36 containing the article 16 therein is thereby urged downwardly towards the container 12 in the previously described manner. After the carriage moves away from the photoelectric scanner 156, mounted on the frame bracket 38, the scanner no longer senses the presence of the article 16 and the scanner-controlled relay 196 opens the contact 198. However, due to the closed status of contact 176, the control relay 174 remains sealed, the contact 178 remains closed, and voltage is maintained at the solenoid coil 145 to hold the valve 132 in the second position and thereby continue the downward movement of the carriage until the carriage arrives at a varying second position.

The varying second position may be located a preselected distance above either the bottom of the container 12, or if present, articles 16 previously placed within the container as shown in FIG. 3. The first means 158 senses the location of the varying second position by contacting at least one of the spaced apart flexible members 160 with the articles 16 or the bottom plate 14 of the container 12. When such contact is established, an electrical series circuit is established including therein the wire 212, the flexible member 160, the articles 16, the container 12, the electrically conductive support member 206, the wire 208, and the resistance sensitive relay 180. The resistance sensitive relay directs a current of approximately 10 volts, through the circuit thus established between the members 160 and the articles 16 and, in response to this signal passing from the first means 158 through the container 12 and to the second means 170, opens the contact 182 and closes the contact 184 to provide line voltage to the second control relay 186.

In response to the voltage thus applied to the second control relay 186, the contact 192 is closed to seal the relay 186 even though there may be a momentary break in physical contact between the flexible members 160 and the article 16. The second control relay operates to close the contact 194 and thereby energize the solenoid coil 103 to shift the valve 94 to the previously described second position. When the valve 94 is thus moved to the second position, the piston 76 retracts into the cylinder to open the gates 52, 54 and thereby controllably discharge the article 16 from the carriage 32 in response to the carriage being at the aforementioned second position. The actual drop height of the article is determined by the length of the flexible members 160 and preferably is in the order of 1 to 2 inches (25 to 50 mm).

In response to the voltage supplied thereto, the second control relay 186 also simultaneously opens the contact 188, thereby dropping the first control relay 174 out of the circuit. The contacts controlled by relay 174 thus revert to their normal positions, the contacts 176 and 178 being normally open and voltage is interrupted to the solenoid coil 145. As a result, the spring biased valve 132 returns to the original position and the carriage is returned from the varying second position as typified in FIG. 3 to the predetermined first position of FIGS. 1 and 2.

To prevent premature closure of the gates 52,54, and to provide clearance for the carriage prior to closure of the gates, the time delay to open contact 190 is also controlled by the second control relay 186 and provides a 1 to 2 second delay before gate closure. Upon opening of the contact 190, the seal on the relay 186 provided by the contact 192 is broken and voltage to the relay is interrupted. Consequently, the contacts 188, 190, 192 and 194 controlled by the relay 186, revert to their normal position and voltage to the solenoid coil 103 is interrupted. With the solenoid coil 103 de-energized, the spring biased valve 94 will return to the original position, extending the piston 76 and closing the gates 52,54. This latter action occurs simultaneously with return of the carriage to the first predetermined position as outlined above. After return to the first position, introduction of another article 16 into the carriage 32 from the conveyor 18 will again automatically initiate operation of the article transfer apparatus 10 to move the carriage 36 from the first position to a varying second position and discharge the article at the new second position in response to the first means 158 sensing the second position and delivering a signal to the second means 170.

As a precaution against possible damage to the article transfer apparatus 10 by inadvertent operation when a container 12 is not in place below the carriage 36, the angle bracket 150 mounted on the guide rod 146 is adjustably positioned on the guide rod to contact the limit switch 152 prior to overextension of the cylinder 106. As shown schematically in FIG. 5, the limit switch is normally closed to provide voltage, when desired, to contacts 188, 176, and open across a circuit parallel to contacts 190 and 192. However, when tripped by contact with angle bracket 150, the limit switch operates to break the circuit to contacts 188 and 176, thereby interrupting voltage to the first control relay 174, and provide voltage to the second control relay 186. This action causes carriage 36 to immediately return to the raised or first predetermined position.

In addition to the foregoing description of the automatic mode operation of the article transfer apparatus 10, provision is also made for operation in a manual mode. For such manual operation, the switch 200 is moved to interrupt the circuits supplying voltage to the first and second control relays 174 and 186 as indicated by the dashed position of the switch 200 in FIG. 5. The switches 202 and 204 are then held closed to respectively bypass the normally open contacts 178 and 194. Closure of the switches 202 and 204 will then provide voltage to the respective solenoids 145 and 103 for translation of the spring biased valves 132 and 94 to lower the carriage 36 and open the gates 52,54 as described in conjunction with the automatic mode operation.

Other aspects, objects and advantages of this invention can be obtained from a study of the drawings, the disclosure and the appended claims.

What is claimed is:

1. In an article transfer apparatus (10) for sequentially transferring electrically conductive articles (16), said apparatus (10) having a frame (20), a vertically movable carriage (36) disposed within the frame (20), means (104) for moving the carriage (36) between a predetermined first position and a varying second position, and means (64) for discharging the articles (16) from the carriage (36) and into a container (12) in response to said carriage (36) being at the second position located a preselected distance above one of the bottom of the container (12) and articles (16) within the container (12), the improvement comprising:

first means (158) for sensing the location of said varying second position and delivering a signal in response to said means being at said varying second position, said first means (158) being a plurality of spaced apart flexible members (160) depending from said carriage (36);

second means (170) for receiving said delivered signal and discharging said article (16) in response to receiving said signal, said signal being an electrical signal passing from said first means (158) through the container (12) and to the second means (170); and, sensor means (154) for detecting the presence of an article (16) in said carriage (36) in response to said carriage (36) being at the first position.

2. The article transfer apparatus (10), as set forth in claim 1, including:

an electrically conductive support member (206) disposed in supporting relationship with said container (12) and being electrically connected to said second means (170).

3. The article transfer apparatus (10), as set forth in claim 1, wherein the first means (158) is a plurality of woven wire cables (162) each having an electrically conductive weight (164) attached at a first end and each being mounted at a second end on said carriage (36).

4. An article transfer apparatus (10), comprising:

a frame (20);

a carriage (36) having a pair of sidewalls (40,42), an end wall (44) and a bottom member (48) movable between an open and a closed position, said carriage (36) being movably mounted on said frame (20);

means (104) for vertically moving said carriage (36) between a predetermined first position and a varying second position within a container (12);

means (64) for moving the bottom member (48) of said carriage (36) between said open and closed positions;

first means (158) for sensing said varying second position and delivering a signal in response to said means (158) being at said varying second position, said first means (158) being a plurality of spaced apart flexible members (160) depending from said carriage (36);

second means (170) for receiving said delivered signal and discharging said article (16) in response to receiving said signal, said signal being an electrical signal passing from said first means (158) through the container (12) and to the second means (170); and, sensor means (154) for detecting the presence of an article (16) in said carriage (36) in response to said carriage (36) being at the first position.

5. The article transfer apparatus (10), as set forth in claim 4, wherein the means for moving the bottom member (148) of said carriage (36) includes:

an air cylinder (66) having an inlet (68) for pressurized air at a first end (70), an inlet (72) for pressurized air at a spaced second end (74), a piston (76) having a head (78) movably disposed in said cylinder (66) and a rod end (80) connected to the head (78);

a plurality of links (60, 62, 82, 84, 86) connecting the rod end (80) of said piston (76) to said bottom member (148) of said carriage (36);

a source of pressurized air (88); and, a first valve means (90) for controlling the flow of pressurized air to said cylinder (66) in response to a signal received from said second means (170).

6. The article transfer apparatus (10) as set forth in claim 4 wherein the means (104) for vertically moving the carriage (36) includes:

an air over oil cylinder (106) having an inlet (108) for pressurized air at a first end (110), an inlet (112) for pressurized oil at a spaced second end (114), and a piston (116) having a rod portion (118) connected to the carriage (36) and a head portion (120) movably disposed within the cylinder (106);

a source of pressurized air (88);

a source of pressurized oil (122); and a second valve means (124) for controlling the flow of pressurized air and oil to said cylinder (106) in response to a signal received from said second means (170).

7. The article transfer apparatus (10), as set forth in claim 4, including;

an electrically conductive support member (206) disposed in supporting relationship with said container (12) and electrically connected to said second means (170).

8. The article transfer apparatus (10), as set forth in claim 4, wherein the first means (158) is a plurality of woven wire cables (162) each having an electrically conductive weight (164) attached at a first end and each being mounted at a second end on said carriage (36).

* * * * *